US010927560B2

(12) United States Patent
Bridgeman et al.

(10) Patent No.: US 10,927,560 B2
(45) **Date of Patent: *Feb. 23, 2021**

(54) MODULAR CRYPT

(71) Applicant: MATTHEWS INTERNATIONAL CORPORATION, Pittsburgh, PA (US)

(72) Inventors: Kenneth B. Bridgeman, Pittsburgh, PA (US); Charles T. Young, Pittsburgh, PA (US)

(73) Assignee: Matthews International Corporation, Pittsburgh, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/921,449

(22) Filed: Mar. 14, 2018

(65) Prior Publication Data

US 2018/0305949 A1 Oct. 25, 2018

Related U.S. Application Data

(60) Continuation of application No. 15/010,059, filed on Jan. 29, 2016, now Pat. No. 9,945,147, which is a (Continued)

(51) Int. Cl.
*E04H 13/00* (2006.01)

(52) U.S. Cl.
CPC ..... *E04H 13/006* (2013.01)

(58) Field of Classification Search
CPC ..... E04H 13/00; E04H 13/006; E04H 13/008

(Continued)

(56) References Cited

U.S. PATENT DOCUMENTS 1,406,192 A * 2/1922 Kennedy ..... A47B 47/03 312/107
1,453,375 A * 5/1923 Allen ..... E04H 13/006 52/134

(Continued)

FOREIGN PATENT DOCUMENTS

CA 2702682 A1 10/2010
CA 2762740 A1 7/2012

(Continued)

OTHER PUBLICATIONS

Agganciare/Ripiani Ai 4 Pilastri Gia Posizionait, Partendo Dal Basso, Ferrarini System, at least as early as 2009.

(Continued)

*Primary Examiner* — Ryan D Kwiecinski
(74) *Attorney, Agent, or Firm* — Troutman Pepper Hamilton Sanders LLP

(57) ABSTRACT

A modular crypt structure comprising a frame, a module insert defining a chamber and a closure panel and methods of constructing the same are disclosed. The chamber functions as a crypt module and is adapted to receive bodily remains or portions thereof. The chamber is closed by attaching a closure panel, such as a stone crypt front to the frame, thereby encapsulating bodily remains. The modular crypt structure may comprise a plurality of chambers, thereby providing a plurality of crypt modules, and the frame may comprise a plurality of horizontal bars and a plurality of vertical bars. A method of constructing a modular crypt structure comprises erecting a frame, providing at least one module insert, configuring the insert to define a chamber adapted to receive bodily remains, and closing the crypt module.

28 Claims, 10 Drawing Sheets

Related U.S. Application Data division of application No. 12/762,645, filed on Apr. 19, 2010, now Pat. No. 9,249,598.

(60) Provisional application No. 61/174,058, filed on Apr. 30, 2009.

(58) Field of Classification Search
USPC ..... 52/124.1, 128, 134, 133, 136, 137, 139, 52/142; 27/1
See application file for complete search history.

(56) References Cited

U.S. PATENT DOCUMENTS 2,513,951 A * 7/1950 McClellen ..... E04H 13/006 27/1
3,183,574 A * 5/1965 Diem ..... E04H 13/006 27/1
3,254,773 A * 6/1966 Diem ..... E04H 13/006 211/85.27
3,529,730 A * 9/1970 Thompson ..... E04H 13/006 211/85.27
3,754,805 A * 8/1973 Pangburn ..... E04H 13/006 312/111
3,897,663 A * 8/1975 Gaul ..... E04H 13/006 52/136
4,048,772 A 9/1977 Gaul
4,073,100 A * 2/1978 DiGiovanni, Jr. .... E04H 13/006 52/136
4,433,883 A * 2/1984 Boender ..... G09F 5/00 211/191
4,523,413 A 6/1985 Koppenberg
4,648,219 A * 3/1987 Johnston, Sr. ..... E04H 13/00 52/125.2
4,669,157 A * 6/1987 Schwarten ..... A61G 17/00 27/1
4,862,655 A 9/1989 LePage et al.
4,928,447 A * 5/1990 Stoecklein ..... E04H 13/006 52/134
5,115,607 A * 5/1992 Pirozzoli ..... E04H 13/006 52/134
5,243,794 A 9/1993 Pikor
5,408,787 A * 4/1995 Barnett ..... E04H 13/00 27/6
5,419,091 A * 5/1995 Roberts ..... E04H 13/006 52/134
5,894,699 A * 4/1999 Fulton ..... E04H 13/006 52/128
5,899,045 A * 5/1999 Giannarelli ..... E04H 13/006 52/745.01
6,105,315 A * 8/2000 Stoecklein ..... E04H 13/006 27/1
6,250,025 B1 * 6/2001 Darby ..... E04H 13/006 52/137
6,578,323 B1 * 6/2003 Zartman ..... E04H 13/006 27/1
6,681,534 B2 * 1/2004 David ..... E04H 13/00 27/1
6,799,399 B2 * 10/2004 Dudek ..... E04H 13/00 27/7
7,415,800 B2 8/2008 Steinwand
7,591,053 B2 9/2009 Bosisio et al.
7,926,228 B1 * 4/2011 Snow ..... E04H 13/006 52/136
9,080,344 B2 * 7/2015 Young ..... E04H 13/006
9,249,598 B2 2/2016 Bridgeman et al.
9,458,643 B2 * 10/2016 Young ..... E04H 13/006
2009/0229197 A1 * 9/2009 Bach Lahor ..... E04H 13/006 52/142
2010/0162639 A1 * 7/2010 Adair ..... G06Q 30/0601 52/103
2010/0275529 A1 11/2010 Bridgeman
2011/0154748 A1 6/2011 Young et al.
2016/0138292 A1 * 5/2016 Young ..... E04H 13/006 52/745.02
2016/0251871 A1 9/2016 Bridgeman et al.
2017/0089091 A1 3/2017 Young et al.

FOREIGN PATENT DOCUMENTS

MX 2010004649 A 11/2010
MX 2912999468 A 7/2012

OTHER PUBLICATIONS

Osisio Antica Fonderia D'Arte Catalogo Cimiteri 2008, Catalog.
Strutture Prefabbricate: Schedario Dei Collegamenti, May 2007.

* cited by examiner

MODULAR CRYPT

CROSS REFERENCE TO RELATED APPLICATIONS

This application claims the benefit of U.S. Provisional Application No. 61/174,058, filed Apr. 30, 2009, the entire content of which is hereby incorporated by reference.

BACKGROUND OF THE INVENTION

Field of the Invention

This invention relates to an indoor or outdoor modular crypt structure and, in particular, to a crypt structure which minimizes the need to pour concrete to construct the crypt structure.

Description of Related Art

Crypt structures, or alternatively mausoleums, are structures that comprise a plurality of chambers for the entombment of bodily remains and/or corpses. Normally, crypt structures are above-ground structures which are freestanding or located within an existing building. The exteriors of these structures are oftentimes covered with granite, marble or other various finish materials to make them aesthetically pleasing.

Crypt structures are generally constructed in situ by pouring concrete into erected forms, usually constructed of wood, to form the walls and chambers of the crypt structure. This process is expensive and time consuming. The forms are removed after the concrete has cured. Oftentimes, concrete can contain excessive voids which can compromise structural integrity. Thus, skilled laborers must usually be employed to ensure proper formation of the crypt structure. Some circumstances require that the concrete crypts are precast off-site. This would require the additional expenses associated with transporting and installing concrete structures of great weight. Special installation equipment, such as large trucks, cranes, or the like may also be required to properly install such constructions.

Some examples of modular crypt structures can be found in U.S. Pat. No. 4,048,772 to Gaul; U.S. Pat. No. 5,243,794 to Pikor; and U.S. Pat. No. 6,105,315 to Stoecklein et al. The assemblies disclosed in these patents require almost complete fabrication of the crypt chambers and chamber walls prior to erecting the resulting crypt structure at the installation site, thereby still necessitating significant expense.

Therefore, a need exists to provide a modular crypt structure which overcomes the above-described deficiencies.

SUMMARY OF THE INVENTION

One embodiment of the present invention is directed to a modular crypt structure comprising a first frame, at least one module insert comprising a plurality of walls defining a chamber having at least one open end, and a closure panel. The insert is positioned within the first frame and the chamber adapted to receive bodily remains, which may be contained within a casket. The closure panel is attached to the first frame at an end adjacent to the at least one open end of the insert. The module insert may include both one open end and one closed end. The first frame may comprise a plurality of horizontal bars vertically aligned with one another, a plurality of vertical bars horizontally aligned with one another, and a plurality of support beams. The horizontal bars may intersect the vertical bars and the support beams may intersect the horizontal bars in a horizontal plane, thereby forming a platform. The module insert may then be positioned on the resulting platform. The crypt module may also comprise a crypt sealing cap, which is attached to the module insert at an end adjacent to the at least one end of the chamber. Additionally, the modular crypt structure may comprise a plurality of module inserts. The module inserts may each comprise a plurality of walls defining a plurality of chambers having at least one open end, wherein the inserts are situated within the first frame, and the chambers function as crypt modules for the insertion of bodily remains. The modular crypt structure may also comprise a trim plate which is attached to a bottom portion of the frame.

In other embodiments, the frame may comprise a metal, such as aluminum, the module insert may comprise a plastic, fiberglass, polymer material, or a metal, and the closure panel may comprise marble or granite.

In one embodiment of the present invention, the modular crypt structure comprises an anchor assembly for attaching the closure panel to the frame. The anchor assembly may secure the periphery of the closure panel to the frame. The anchor assembly may comprise an anchor assembly body, a spring-loaded flange, an extension attached to the anchor assembly body and defining a hole therein, at least one bolt, a rosette defining a hole therein, and a screw. The bolt secures the anchor assembly body to the frame, and the screw extends through the rosette hole and the extension hole, such that the screw secures the rosette to the extension. The closure panel rests on a top surface of the extension, and the spring-loaded flange biases the rear surface of the closure panel such that the front surface of the closure panel is biased against the rosette. The anchor assembly may also comprise bronze and/or stainless steel.

Yet another embodiment is directed to a modular crypt structure which comprises a second frame. The second frame may be positioned such that a back end of the second frame is adjacent to a back end of the first frame. The first frame and second frame may also be integrally formed. In these embodiments, the module insert may comprise a second open end and extend through the first and second frames. Alternatively, this embodiment may comprise at least two inserts, each comprising a plurality of walls defining chambers having at least one open end. A first insert is positioned within the first frame with the at least one open end located at an end of the first frame opposite the back end of the first frame. A second insert is positioned within the second frame with the at least one open end located at an end of the second frame opposite the back end of the second frame. The chambers are adapted to receive bodily remains or portions thereof. A second closure panel may be attached to the second frame at an end opposite the back end of the second frame.

Further, the present invention is directed to an embodiment comprising a roof and at least two walls. A first wall may be positioned parallel to a first side of the first frame, and a second wall may be positioned parallel to the second side of the first frame. The roof may be positioned above the frame and supported by the first and second walls such that the first frame is surrounded by the roof and walls. The modular crypt structure may also comprise a plurality of wall support bars. The wall support bars may be positioned on the first and second sides of the frame, such that they bias an inside surface of the first and second wall. Alternatively, when the frame comprises a plurality of vertical bars, the roof may extend across the width and length of the frame being supported by and secured directly to the vertical bars.

Lastly, other embodiments of the present invention are directed to methods for constructing a modular crypt and for encapsulating bodily remains. These methods may comprise the steps of erecting a frame; providing at least one module insert; configuring the insert to define a chamber having at least one open end adapted to receive bodily remains or portions thereof; positioning the module insert in the frame; and closing the crypt module at an end associated with the at least one open end of the module insert. The methods may also comprise attaching a closure panel to the frame at an end of the frame associated with the at least one open end of the chamber. Further, walls and a roof may be provided around the frame. The method for encapsulating bodily remains may further comprise inserting bodily remains or portions thereof into the crypt module before closing the crypt module and providing a sealing cap in the chamber near the open end of the chamber. Both methods may comprise providing a plurality of vertical bars, horizontal bars and support beams; aligning the vertical bars horizontally and the horizontal bars vertically in an intersecting manner; forming a platform by arranging the support beams in a horizontal plane with the horizontal bars such that they intersect the horizontal bars; and positioning the module insert on the platform.

DESCRIPTION OF THE PREFERRED EMBODIMENTS

In the following Description of the Preferred Embodiments, "crypt module" is a chamber, vault, or another space defined within a crypt structure or mausoleum for encapsulating and/or entombing bodily remains.

"Module insert" is a piece of material which defines a crypt module within a frame according to the present invention. The module insert may be a flexible or a rigid material. It may comprise plastic, a polymer, fiberglass, or any material sufficient to encapsulate and/or entomb bodily remains.

"Bodily remains" refers to deceased persons and/or animals, human and/or animal corpse or corpses, portions of corpses and/or deceased persons, cremated remains, or any combination thereof, either enclosed in a casket and/or coffin or not.

For purposes of the description hereinafter, spatial orientation terms, if used, shall relate to the referenced embodiment as it is oriented in the accompanying drawing Figs. or otherwise described in the following detailed description. However, it is to be understood that the embodiments described hereinafter may assume many alternative variations and embodiments and that the specific embodiments illustrated in the accompanying drawing Figs. and described herein are simply exemplary and should not be considered as limiting.

Figure 1:
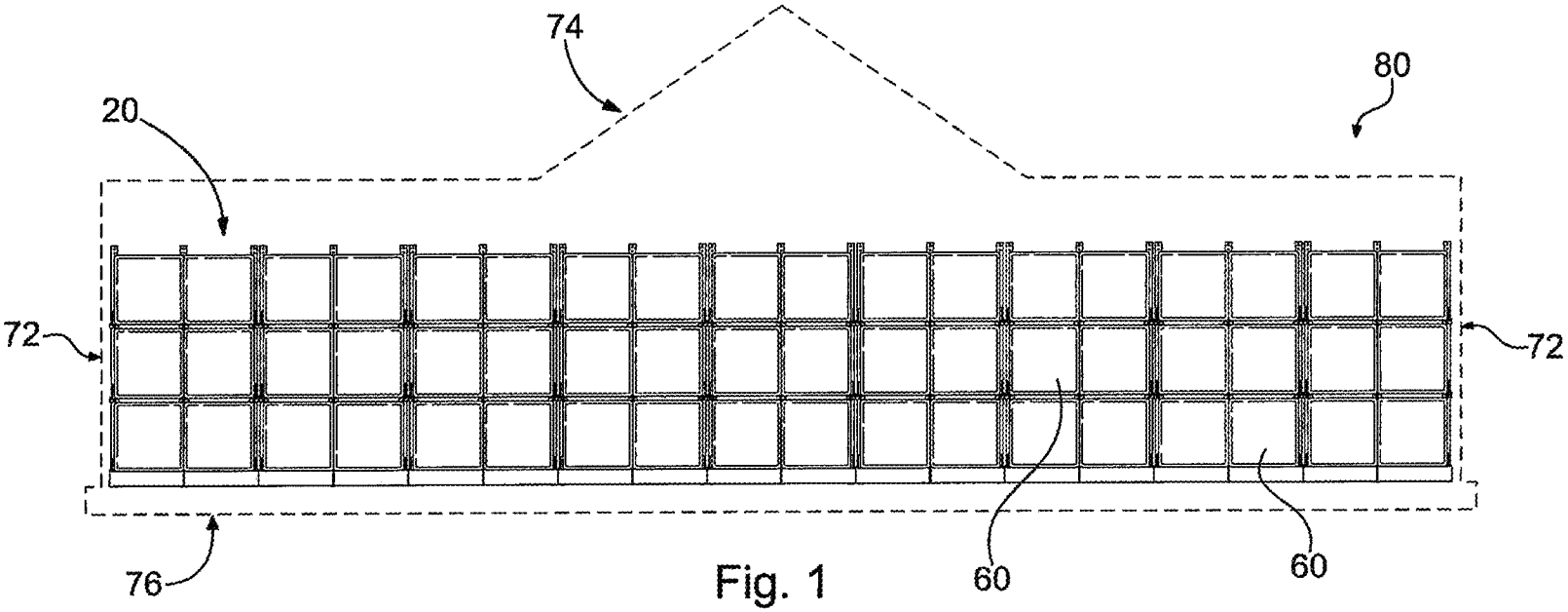
FIG. 1 shows a modular crypt structure with schematically represented walls, roof, and base.
Figure 2:
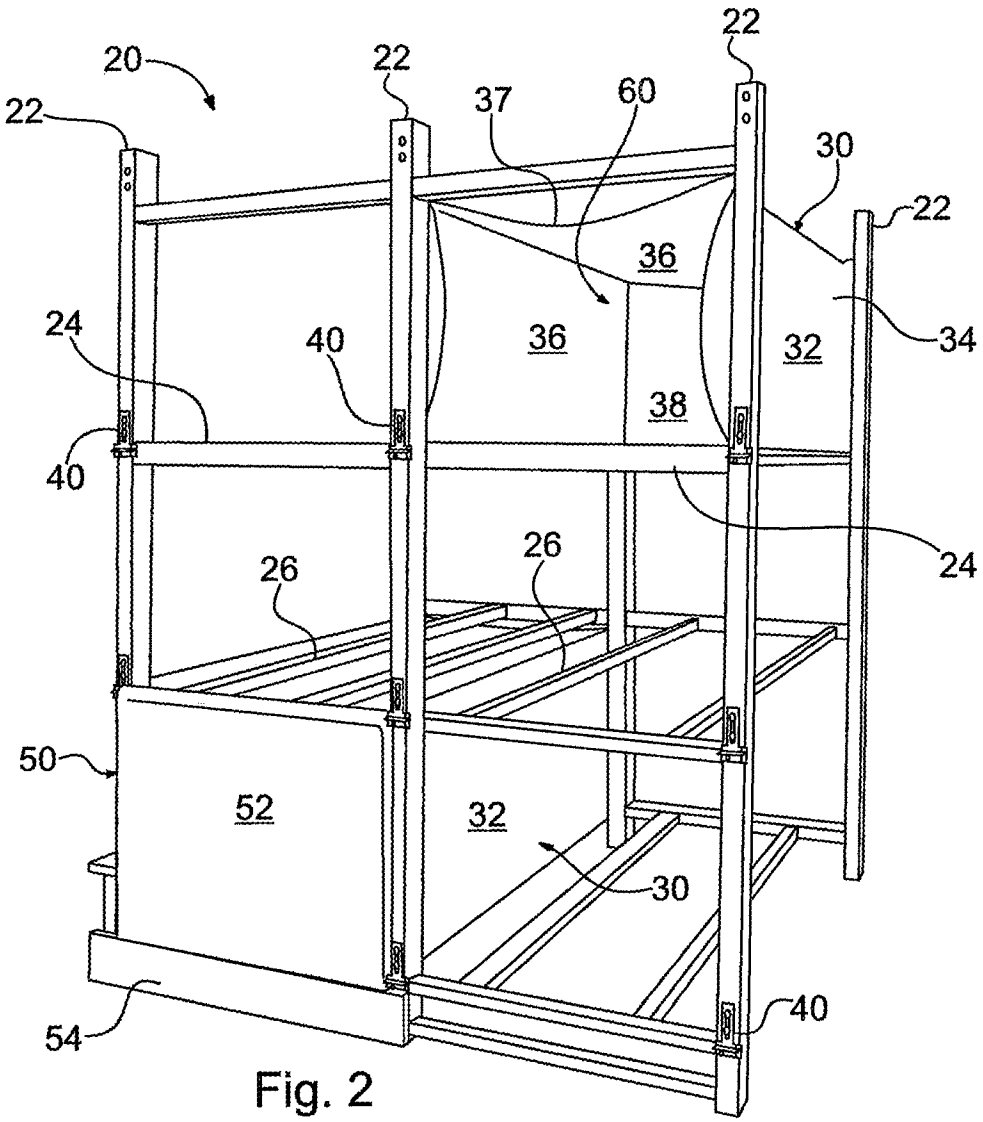
FIG. 2 shows a modular crypt structure frame with a module insert therein and attached closure panel.
Figure 5:
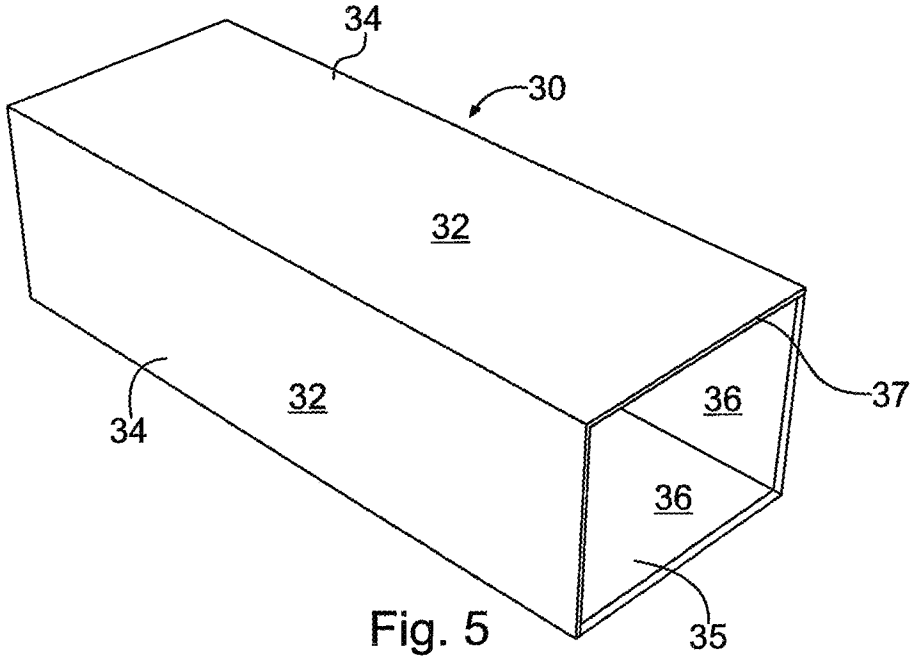
FIG. 5 shows a module insert construction.

FIG. 1 shows an embodiment of the present invention, wherein a modular crypt structure 80 comprises a frame 20, which defines spaces, or alternatively crypt modules 60, for insertion of bodily remains. Frame 20 sits atop a base 76, and is covered by a roof 74, which is supported by walls 72. A crypt module 60 is formed by placing a module insert 30 within frame 20, as indicated in FIG. 2. Module insert 30, which is shown in FIG. 5, includes walls 34 with outside surfaces 32 and inside surfaces 36. Walls 34 define a chamber 35 having a chamber opening 37 at an end of module insert 30. Generally, an end of module insert 30 opposite chamber opening 37 is sealed, as represented by rear wall surface 38 in FIG. 2. Chamber 35 functions as crypt module 60 for insertion of bodily remains or portions of bodily remains when module insert 30 is placed within frame 20. Crypt module 60 may also be closed by attaching a closure panel 50 having front face 52, such as a stone crypt front, to an end of frame 20 adjacent to chamber opening 37 of module insert 30, thereby encapsulating the bodily remains.

Figure 3:
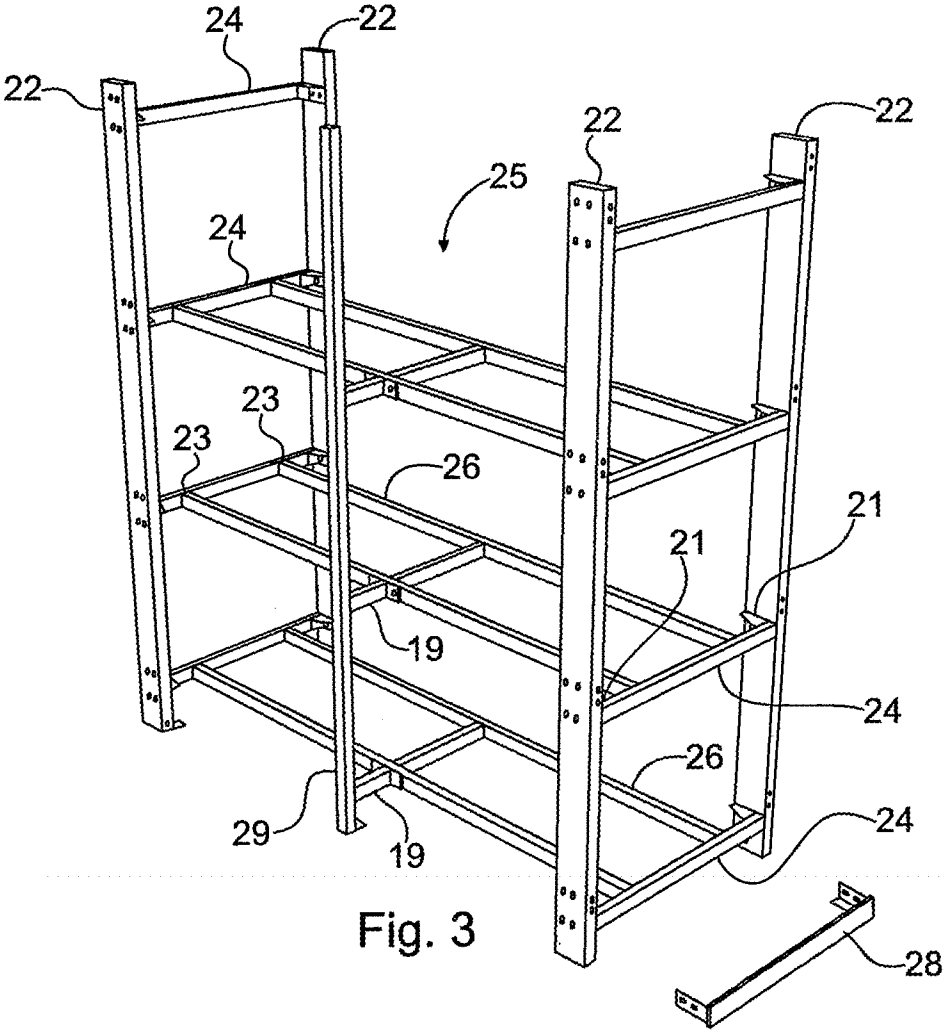
FIG. 3 shows a perspective view of a frame assembly.
Figure 4:
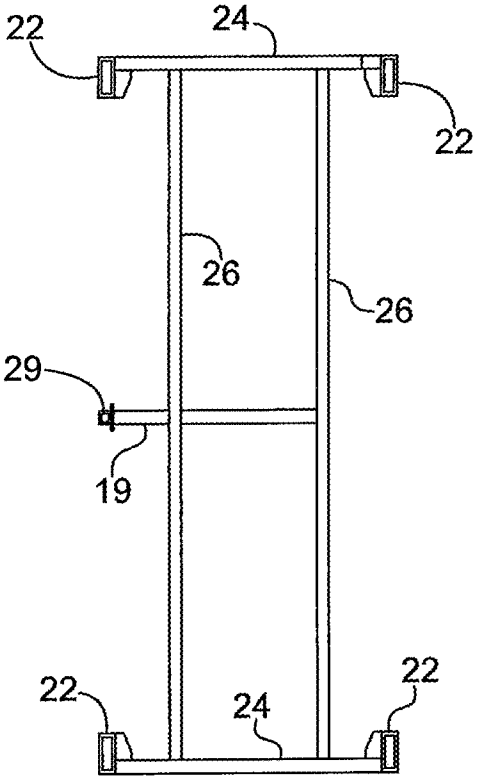
FIG. 4 shows a bottom view of a platform formed by a frame assembly.

As shown in FIG. 3, frame 20 comprises a plurality of vertical bars 22 horizontally aligned and a plurality of horizontal cross bars 24 vertically aligned. Additionally, frame 20 may comprise a plurality of support beams 26 which are vertically aligned. Cross bars 24 are perpendicularly oriented to and intersect vertical bars 22 in a vertical plane. As shown in FIGS. 3-4, when cross bars 24 and support beams 26 intersect and are perpendicularly oriented in a horizontal plane, cross bars 24 and support beams 26 form a platform 25 for supporting module insert 30. Cross bars 24 may be attached to vertical bars 22 via nuts and bolts at joints 21, and cross bars 24 and support beams 26 may be welded at joints 23. Alternatively, horizontal cross bars 24, vertical bars 22 and support beams 26 may be integrally formed. However, any means of attachment sufficient to support module insert 30 are contemplated. Moreover, frame 20 may comprise any material or combination of materials sufficient to support the weight of bodily remains, and preferably comprises a metal, such as steel or aluminum. The vertical bars 22 may, for example, comprise 2 inch by 5 inch tube aluminum and horizontal cross bars 24 and support beams 26 comprise 1.5 inch by 2 inch tube aluminum.

As noted above and as shown in FIG. 5, module insert 30 comprises walls 34 having outside surfaces 32 and inside surfaces 36, wherein walls 34 form a chamber 35 having chamber opening 37. Module insert 30 is then placed within frame 20 on top of and supported by platform 25, as shown in FIG. 2. In this configuration, chamber 35 of module insert 30, functioning as a crypt module 60, may receive bodily remains. Typically, the bodily remains take the form of a corpse encapsulated within a casket and/or coffin; however, crypt module 60 may receive other forms of bodily remains, such as cremated remains. Frame 20 may comprise a plurality of platforms 25, as indicated in the embodiments represented by FIGS. 2-3. As such, a plurality of module inserts 30 may be placed within frame 20. Module insert 30 may comprise any material sufficient to receive and retain bodily remains, such as a plastic material, a polymer material, fiberglass or a metal, for example aluminum.

Figure 9:
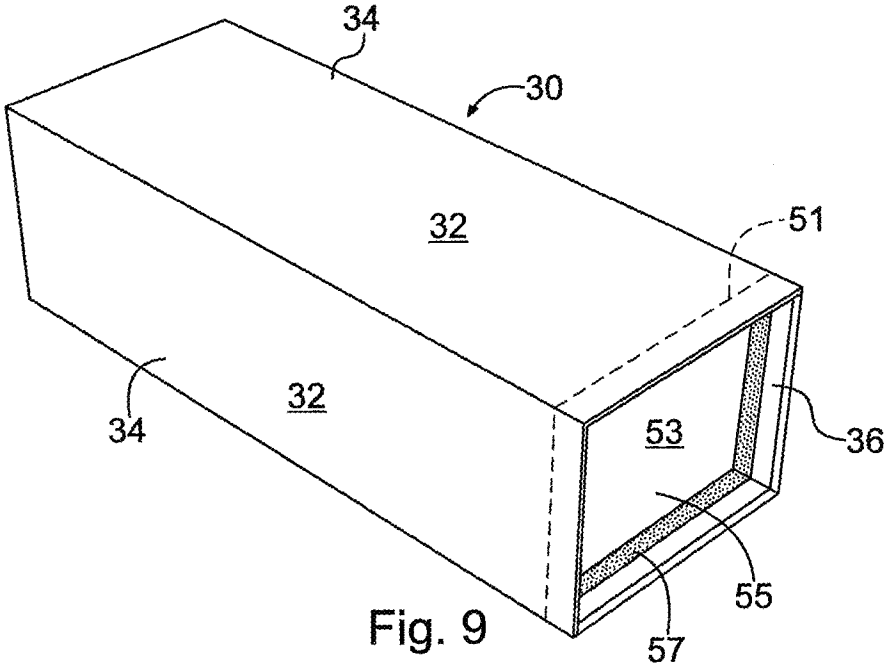
FIG. 9 shows a module insert in conjunction with a crypt sealing cap.

When module insert 30 or a plurality of module inserts 30 have been placed within frame 20, crypt module 60 or a plurality of crypt modules 60 may be sealed by attaching a closure panel 50 or a plurality thereof to an end of frame 20 adjacent chamber opening 37, as shown in FIG. 2. As illustrated, front face 52 of closure panel 50 may be larger than the chamber opening 37 of module insert 30, thereby allowing closure panel 50 to completely conceal chamber opening 37. The closure panel 50 biases and is attached to a front side of frame 20. A crypt module 60 may also comprise a crypt sealing cap 55, as shown in FIG. 9. A crypt sealing cap 55 closes chamber 35 at chamber opening 37, thereby encapsulating the bodily remains prior to attaching closure panel 50 to frame 20. A crypt sealing cap 55 may comprise a fluid-tight material for preventing leakage of fluid into and/or out of crypt module 60. In the embodiment shown in FIG. 9, the crypt sealing cap 55 comprises a U-shaped cap, having a concave surface 53, wherein external surfaces of lips 57 of concave surface 53 of sealing cap 55 contact inside surfaces 36 of module insert 30, thereby fluidly sealing crypt module 60. Line 51 indicates the depth of crypt sealing cap 55 within chamber 35.

Figure 7:
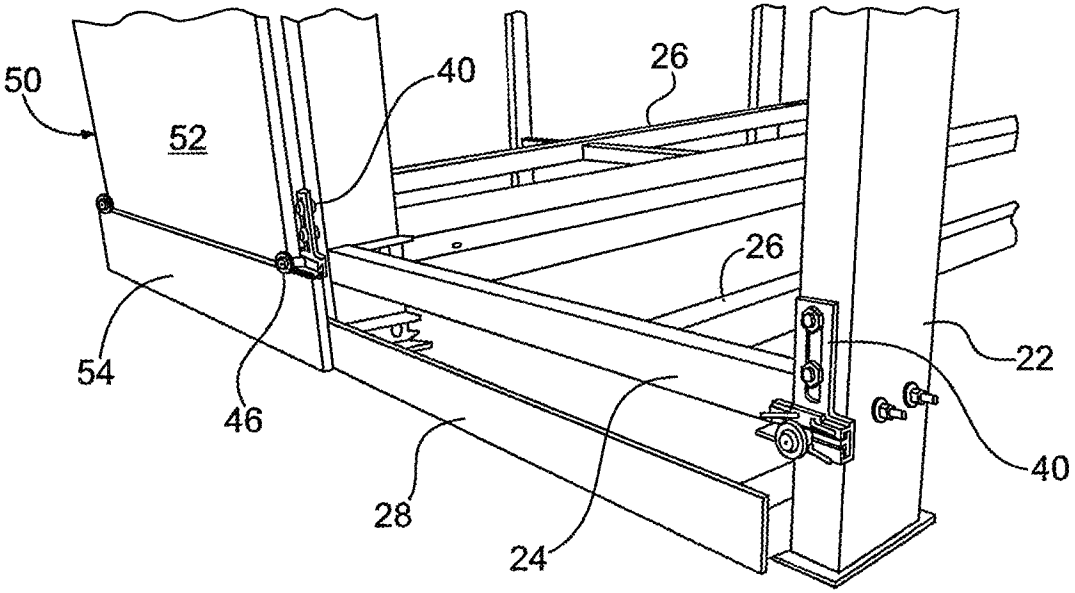
FIG. 7 shows a perspective view of a closure panel which is attached to a frame.

FIGS. 2 and 7 show a closure panel 50 attached to both frame 20 and a trim plate 54, which is attached to frame 20 at a bottom portion thereof. Trim plate 54 may be biased by a base plate 28 shown in FIG. 7. Base plate 28 biases a rear face of trim plate 54, thereby providing a stable backing for trim plate 54. A plurality of base plates 28 may extend around the entire perimeter of frame 20 or a portion thereof for supporting a plurality of trim plates 54 along the sides and front and back ends of frame 20. Closure panel 50 and trim plate 54 may comprise a stone material, such as granite or marble to provide an aesthetically pleasing appearance.

Figure 6:
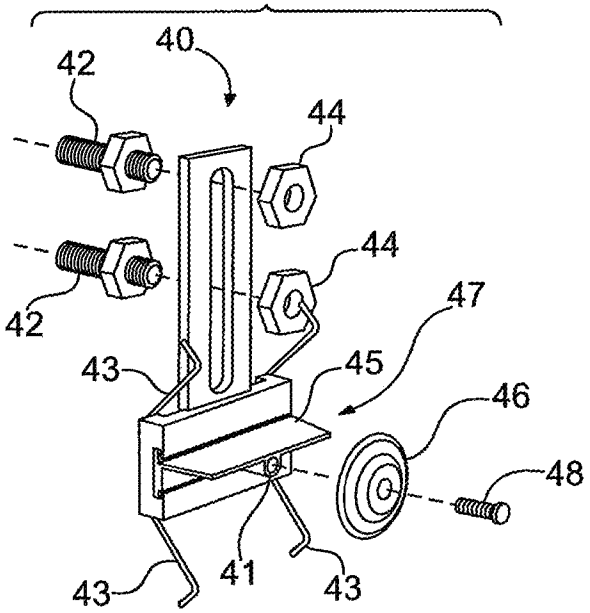
FIG. 6 shows an anchor assembly.

In one embodiment, closure panel 50 and trim plate 54 are secured to frame 20 by an anchor assembly 40. Referring to FIG. 6, the anchor assembly 40 may include nuts 44, bolts 42, spring-loaded flanges 43, rosette 46 and extension 47. In one embodiment, extension 47 is alternatively referred to as a slide, which is removably attached to the body of anchor assembly 40 by sliding thereon. Extension 47 includes top surface 45 and a hole 41. Rosette 46 also may include hole 49. Anchor assembly 40 is secured to frame 20 near joints 21, as shown in FIGS. 2 and 7, by nuts 42 and bolts 44. Referring to FIG. 7, anchor assembly 40 may secure closure panel 50 at a periphery of the closure panel 50 near its corners. Closure panel 50 rests on, and is thereby supported by, top surface 45 of extension 47. Rosette 46 biases a front face 52 of closure panel 50, and is secured by inserting screw 48 through hole 49 of rosette 46 and hole 41 of extension 47. A spring-loaded flange 43 biases a rear surface of closure panel 50 pushing closure panel 50 forward against rosette 46, thereby biasing front face 52 against rosette 46 and securing closure panel 50 in the fore and aft directions. A single anchor assemble 40 may secure up to four closure panels 50, two supported on top surface 45 of extension 47 and two below extension 47, the spring-loaded flanges 43 and rosette 46 biasing corners of a rear surface and the front face 52, respectively, of each closure panel 50. The anchor assembly 40 may comprise an aesthetically pleasing material, such as bronze and/or stainless steel, for example.

Figure 8:
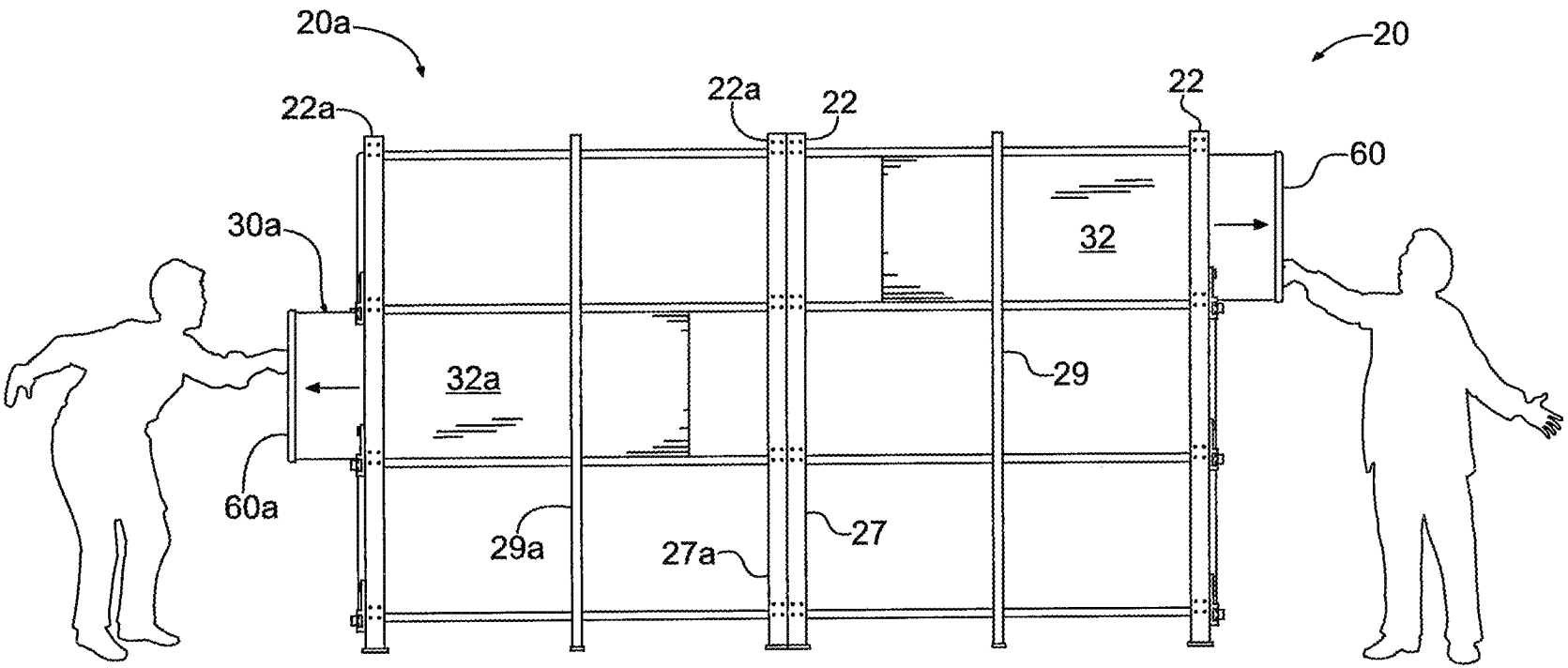
FIG. 8 shows two frame assemblies in a back-to-back orientation.
Figure 10:
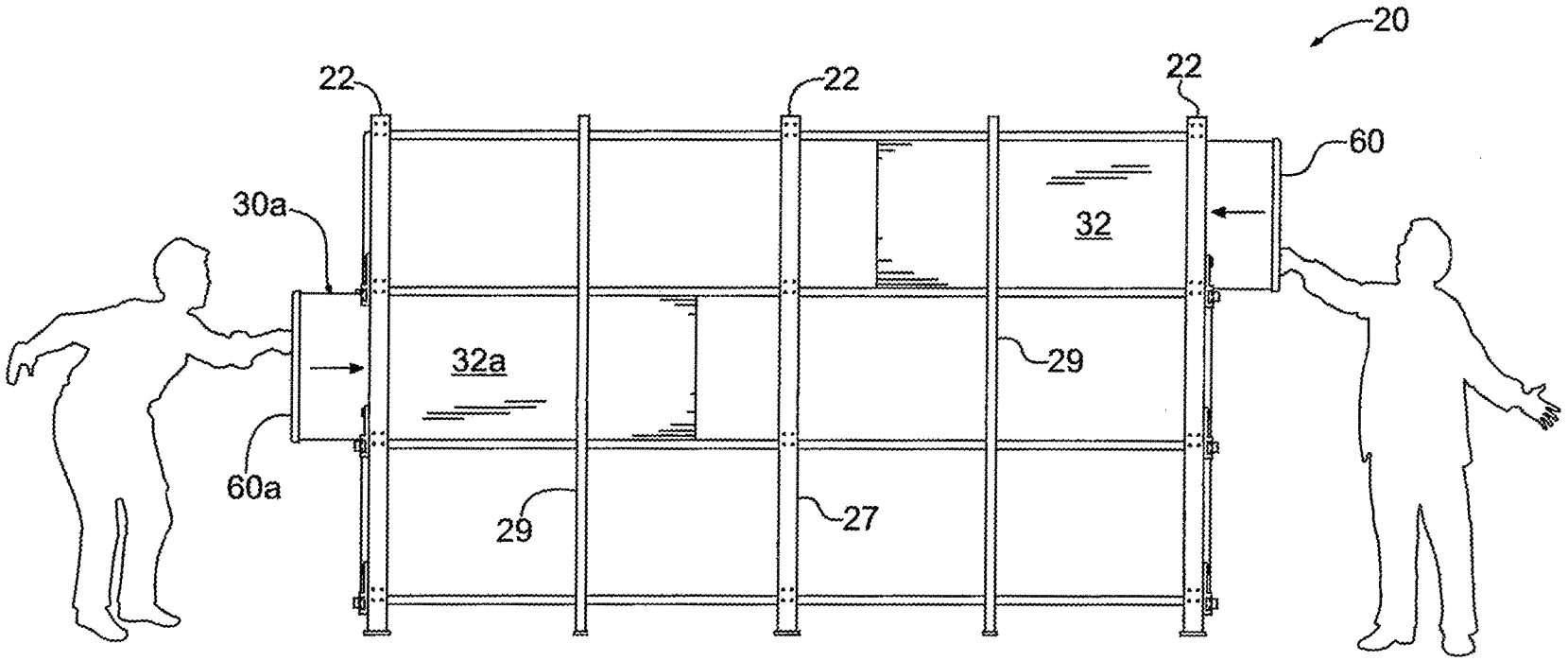
FIG. 10 shows an elongated frame assembly.

Referring to FIG. 8, an alternative embodiment of the described invention comprises a second frame 20*a*. In this embodiment, frames 20 and 20*a* are provided in tandem with back ends 27 and 27*a* oriented adjacent to one another. In this configuration, a modular crypt structure 80 is provided having two opposite ends, wherein module inserts 30 and 30*a* may be placed within frame 20 and second frame 20*a*, respectively, thereby forming two crypt modules 60 and 60*a*, back to back. Closure panels may then be attached to frames 20 and 20*a* to seal respective crypt modules 60 and 60*a*. Alternatively, two crypt modules 60 and 60*a* may be provided back to back in a single integrally formed elongated frame 20, such as that shown in FIG. 10. Additionally, module insert 30 or 30*a* may be formed such that it comprises two opened ends and extends through both frames 20 and 20*a*, supported by platforms 25 and 25*a*, respectively, as shown in FIG. 8, or through elongated frame 20, as shown in FIG. 10, thereby providing a crypt module 60 for the insertion of bodily remains of at least two persons.

Figure 11:
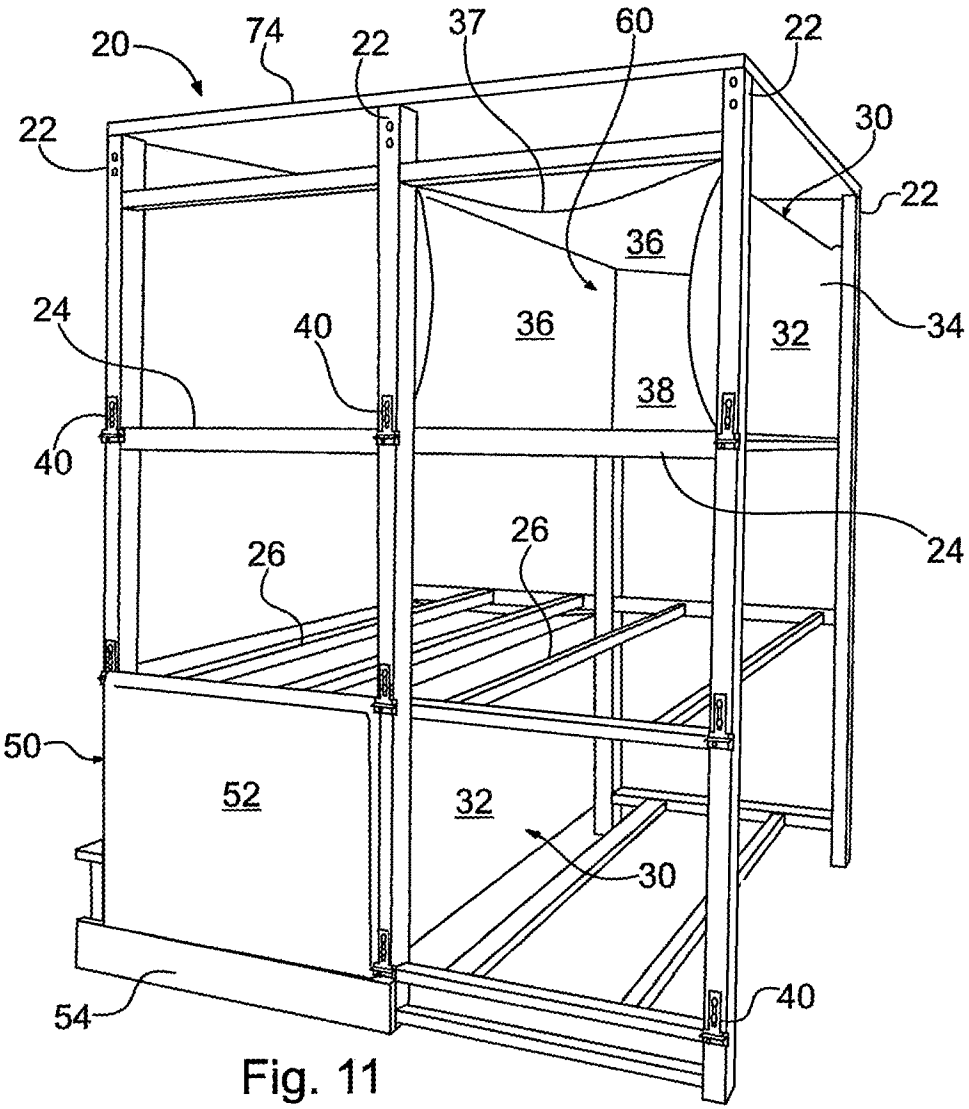
FIG. 11 shows a frame assembly with a roof connected directly to the frame.

A finished modular crypt structure 80 may comprise walls 72, a base 76 and a roof, 74 as shown in FIG. 1, respectively. The walls 72, base 76, and roof 74 may comprise aesthetically pleasing materials, such as granite, marble, brick, or stucco; however, any other materials sufficient for the user's needs are contemplated. Additionally, in a finished crypt structure 80, crypt modules 60 will include a closure panel 50. As such, frame 20 will not be visible, as it is shown in FIG. 1. The walls 72 may run parallel to the sides of frame 20 and in some instances will run behind the rear of frame 20, thereby surrounding frame 20. Roof 74 may then be positioned above frame 20. When a wall 72 is erected and directly attached to a side of frame 20, frame 20 may include a wall support bar 29 or a plurality of wall support bars 29, as shown in FIG. 3. Wall support bar 29, which is attached to frame 20, provides additional stability to wall 72 by biasing an inside face of wall 72. In such constructions, the walls may take the form of multiple plates or a continuous slab of material. Wall support bar 29, as shown, is in a vertical position; however wall support bar 29 may be positioned in other manners, for example, horizontally. As indicated in FIG. 3, wall support bar 29 may be attached to frame 20 via flanges 19. When support bar 29 is positioned in a horizontal manner it may be directly connected to vertical bars 22. Both wall support bar 29 and flanges 19 may comprise 1.5 inch by 2 inch aluminum tube. Alternatively, a finished modular crypt structure 80 may be constructed and housed within an existing or concurrently constructed structure. For example, a frame 20, with accompanying module insert 30 and closure panel 50, may be directly inserted into a block wall structure comprising for example, concrete. A modular crypt structure 80 may be also attached as an extension to a preexisting structure. Referring to FIG. 11, the roof 74 may be secured directed to the frame 20, wherein roof 74 rests directly upon and is supported by vertical bars 22.

On-site, at a place of installation, frame 20 may comprise a plurality of frames 20 in tandem, as discussed above and shown in FIG. 8, side-by-side, as shown in FIG. 1, or in any combination of arrangements. These arrangements may also comprise a single integrally formed frame 20, for example, in FIG. 1, frame 20 may be a single, elongated frame, rather than a plurality of frames, side-by-side. The frame 20 may arrive on-site as a set of separate components, for example, as pluralities of vertical bars 22, horizontal cross bars 24, and support beams 26, to be assembled at the place of installation. Alternatively, the frame 20 may arrive on-site pre-constructed, ready for installation into a pre-existing structure or for erection of new walls around the frame 20. Upon arrival on-site, a frame 20, may be grouped in any desirable arrangement and secured to pre-existing frames. For example, in FIG. 8, frame 20 may arrive on-site, subsequently to frame 20*a*, which would have been previously constructed. Frame 20 may then be arranged and secured in tandem with frame 20*a*.

In any of the above-discussed embodiments, time and man-power are significantly reduced in comparison to that required to build a typical crypt structure. There is no longer a need to pour excessive amounts of concrete using wood forms to construct the entire crypt structure, including each crypt module. The time to construct a modular crypt structure 80 on-site, according to the present invention, is estimated to be approximately one-third of the time required to construct and cure a typical concrete crypt structure. Additionally, with frame 20 comprising a lightweight material, such as aluminum for example, manufacturing and transportation expenses are reduced.

As noted above, while specific embodiments of the invention have been described, it will be appreciated by those skilled in the art that various modifications and alternatives to those details could be developed in light of the overall teachings of the disclosure. The presently preferred embodiments described herein are meant to be illustrative only and not limiting as to the scope of the invention which is to be given the full breadth of the appended claims and any and all equivalents thereof.

The invention claimed is:

1. A modular crypt structure comprising:

a first frame comprising a first side and a second side, a first end transverse to the first side and the second side, and a plurality of individual crypt modules;

at least one module insert, the insert comprising a plurality of walls defining a chamber having at least one open end, wherein the module insert is positioned within the first frame and the chamber is adapted to receive bodily remains;

a closure panel, the closure panel being attached to the first end of the first frame adjacent to the at least one open end of said chamber; and a plurality of wall support bars coupled to the first side and the second side of the first frame, wherein each of the plurality of wall support bars is arranged in a vertical position and is attached to the first frame via at least one flange, and wherein at least one of the plurality of wall support bars biases an inside surface of a wall attached to the first frame.

2. The modular crypt structure according to claim 1, wherein the at least one module insert comprises one open end and one closed end.

3. The modular crypt structure according to claim 1, wherein the first frame comprises a plurality of horizontal bars vertically aligned with one another, a plurality of vertical bars horizontally aligned with one another, and a plurality of support beams, wherein the plurality of horizontal bars intersect the plurality of vertical bars, and the plurality of support beams intersect the plurality of horizontal bars in a horizontal plane, such that a platform is formed, the at least one module insert being positioned on the platform.

4. The modular crypt structure according to claim 1, wherein the at least one module insert is a plurality of module inserts, each of the plurality of module inserts comprising a plurality of walls defining a plurality of chambers having at least one open end, wherein said module inserts are positioned within the first frame, and said plurality of chambers are adapted to receive bodily remains or portions thereof.

5. The modular crypt structure according to claim 1, further comprising a trim plate attached to a bottom portion of the frame.

6. The modular crypt structure according to claim 1, further comprising a crypt sealing cap inserted within the at least one module insert at an end adjacent to the at least one open end of said chamber and contacting an interior surface of at least one of the plurality of walls.

7. The modular crypt structure according to claim 1, wherein the frame comprises aluminum.

8. The modular crypt structure according to claim 1, wherein the at least one module insert comprises a material selected from the group consisting of fiberglass, plastic, polymer material and metal.

9. The modular crypt structure according to claim 1, wherein the closure panel comprises marble or granite.

10. The modular crypt structure according to claim 1, further comprising an anchor assembly for attaching the closure panel to the frame, the anchor assembly securing a periphery of the closure panel to the frame.

11. The modular crypt structure according to claim 10, wherein the anchor assembly comprises:

an anchor assembly body, a spring-loaded flange, an extension attached to the anchor assembly body and defining a hole therein, at least one bolt, a rosette defining a hole therein, and a screw, wherein the at least one bolt secures the anchor assembly body to the frame, the screw extending through the rosette hole and the extension hole, the screw securing the rosette to the extension, the closure panel resting on a top surface of the extension and the spring-loaded flange biasing a rear surface of the closure panel such that a front surface of the closure panel is biased against the rosette.

12. The modular crypt structure according to claim 1, further comprising a second frame, wherein a back end of the second frame is positioned adjacent to a back end of the first frame.

13. The modular crypt structure according to claim 12, comprising at least two module inserts each comprising a plurality of walls defining a plurality of chambers having at least one open end, wherein a first insert is positioned within the first frame, the at least one open end of the first insert located at an end opposite the back end of the first frame, wherein a second insert is positioned within the second frame, the at least one open end of the second insert located at an end opposite the back end of the second frame, the plurality of chambers adapted to receive bodily remains or portions thereof.

14. The modular crypt structure according to claim 12, further comprising a second closure panel, the second closure panel being attached to the second frame at an end opposite the back end of the second frame.

15. The modular crypt structure according to claim 1, further comprising a roof and at least two walls, wherein the first frame comprises a first side and a second side, a first wall positioned parallel to the first side, a second wall positioned parallel to the second side, and the roof being positioned above the frame and being supported by the first and second walls, such that the first frame is surrounded by the roof and first and second walls.

16. The modular crypt structure according to claim 1, wherein each of the plurality of wall support bars is configured to bias an inside surface of a wall attached to the first frame.

17. The modular crypt structure according to claim 1, further comprising a roof, wherein the frame comprises a plurality of vertical bars horizontally aligned, wherein the roof extends across a width and a length of the frame and is supported by and directly secured to the plurality of vertical bars.

18. A method for constructing a modular crypt comprising the steps of:

erecting a frame;

attaching a wall support bar via at least one flange to a first side and a second side of the frame, wherein the wall support bar is arranged in a vertical position;

biasing a wall against the wall support bar attached to at least one of the first side and second of the frame;

providing at least one module insert to be supported by the frame;

configuring said insert such that the insert defines a chamber having at least one open end adapted to receive bodily remains;

positioning the at least one module insert in the frame; and attaching a closure panel to the frame at an end of the frame associated with the at least one open end of said chamber, wherein the end of the frame is transverse to the first side and the second side of the frame.

19. The method of constructing a modular crypt of claim 18, wherein the step of erecting a frame comprises:

providing a plurality of vertical bars;

providing a plurality of horizontal bars;

providing a plurality of support beams;

aligning the plurality of vertical bars horizontally and the plurality of horizontal bars vertically such that the plurality of vertical bars and plurality of horizontal bars intersect; and forming a platform by arranging the plurality of support beams such that they intersect the plurality of vertical bars in a horizontal plane;

wherein, the step of positioning the at least one module insert in the frame comprises positioning the at least one module insert on the platform.

20. The method of constructing a modular crypt of claim 18, further comprising the steps of: providing a plurality of walls and a roof; erecting the plurality of walls around sides of the frame; and positioning the roof above the frame.

21. A method of encapsulating bodily remains comprising the steps of:

erecting a frame;

attaching a wall support bar via at least one flange to a first side and a second side of the first frame, wherein the wall support bar is arranged in a vertical position, and wherein the wall support bar biases an inside surface of a wall attached to at least one of a first side and a second side of the first frame;

providing at least one module insert;

configuring said insert such that the insert defines a chamber having at least one open end;

positioning the at least one module insert in the frame;

inserting bodily remains into the at least one open end of the chamber; and closing the chamber at an end associated with the at least one open end of said chamber with a closure panel attached to the frame at an end of the frame adjacent to the at least one open end of said chamber, wherein the end of the frame is transverse to the first side and the second side of the frame.

22. The method of encapsulating bodily remains of claim 21, wherein the step of closing the chamber further comprises the step of providing a sealing cap inserted within the chamber and contacting an interior surface the chamber near the at least one open end of the chamber.

23. The method of encapsulating bodily remains of claim 21, wherein the step of erecting a frame comprises:

providing a plurality of vertical bars;

providing a plurality of horizontal bars;

providing a plurality of support beams;

aligning the plurality of vertical bars horizontally and the plurality of horizontal bars vertically such that the plurality of vertical bars and plurality of horizontal bars intersect; and forming a platform by arranging the plurality of support beams such that they intersect the plurality of vertical bars in a horizontal plane;

wherein the step of positioning the at least one module insert in the frame comprises positioning the at least one module insert on the platform.

24. A modular crypt structure comprising:

a first frame comprising a first end having a plurality of openings and at least one wall support bar biasing the first frame to an external wall, a first module insert comprising a plurality of walls defining a chamber having an open end adapted to receive bodily remains, wherein each of the plurality of openings is configured to receive the first module insert;

a sealing cap inserted within the open end of the first module insert and contacting an interior surface of at least one of the plurality of walls.

25. The modular crypt structure of claim 24, further comprising a closure panel, the closure panel being attached to the first end of the first frame adjacent to the open end of the chamber.

26. The modular crypt structure of claim 24, wherein the at least one wall support bar comprises a plurality of wall support bars arranged in a vertical position and attached to the first frame via at least one flange at opposing first and second sides, wherein the first and second sides are arranged transverse to the first end.

27. The modular crypt structure of claim 24, further comprising a second module insert comprising a plurality of walls defining a chamber having an open end adapted to receive bodily remains or portions thereof, wherein each of the plurality of openings is configured to receive the second module insert.

28. The modular crypt structure according to claim 24, further comprising a plurality of wall support bars coupled to a first side and a second side of the first frame via at least one flange, wherein each of the plurality of wall support bars is configured to bias an inside surface of a wall attached to the first frame.

* * * * *